US005914172A

United States Patent [19]

Kiser

[11] Patent Number: 5,914,172

[45] **Date of Patent: *Jun. 22, 1999**

[54] ROOFING COMPOSITES AND METHOD

[75] Inventor: Weldon C. Kiser, San Antonio, Tex.

[73] Assignee: Environmental, L.L.C

[ * ] Notice: This patent is subject to a terminal disclaimer.

[21] Appl. No.: 08/774,093

[22] Filed: Dec. 24, 1996

Related U.S. Application Data

[60] Continuation-in-part of application No. 08/437,592, May 9, 1995, Pat. No. 5,587,234, which is a division of application No. 08/187,082, Jan. 26, 1994, Pat. No. 5,453,313, and a continuation-in-part of application No. 08/664,700, Jun. 17, 1996, Pat. No. 5,728,338, which is a division of application No. 08/561,542, Nov. 22, 1995, Pat. No. 5,582,898, which is a continuation-in-part of application No. 08/505,703, Jul. 21, 1995, Pat. No. 5,580,638, which is a continuation of application No. 08/187,082, and a continuation of application No. 08/474,944, Jun. 7, 1995, Pat. No. 5,525,399, which is a continuation-in-part of application No. 08/187,082.

[51] Int. Cl.[6] ..... B32B 5/16; D06N 5/00; B05D 1/12

[52] U.S. Cl. ..... 428/143; 427/186; 427/201; 427/202; 427/203; 427/408; 427/412.1; 428/147; 428/327; 428/489; 428/492

[58] Field of Search ..... 428/487, 489, 428/143, 147, 327, 920, 492; 52/309.1, 311.1, 315, 408, 411, 554, 555, 746, 747; 524/609, 881; 427/186, 201, 202, 203, 408, 412.1

[56] References Cited

U.S. PATENT DOCUMENTS

| | | | |
|---|---|---|---|
| 3,314,205 | 4/1967 | Davis Jr. | 52/309 |
| 3,547,674 | 12/1970 | Draper et al. | 442/123 |
| 3,844,668 | 10/1974 | Winters et al. | 404/72 |
| 3,919,148 | 11/1975 | Winters et al. | 524/62 |
| 4,032,491 | 6/1977 | Schoenke | 428/489 |
| 4,196,115 | 4/1980 | Bresson | 524/68 |
| 4,381,357 | 4/1983 | Wettern et al. | 524/68 |
| 4,588,634 | 5/1986 | Pagen et al. | 428/283 |
| 4,640,730 | 2/1987 | Streets et al. | 156/334 |
| 4,897,137 | 1/1990 | Miller et al. | 156/157 |
| 4,897,443 | 1/1990 | Robinson et al. | 524/609 |
| 5,258,222 | 11/1993 | Crivelli | 428/323 |
| 5,453,313 | 9/1995 | Kiser | 428/143 |
| 5,525,399 | 6/1996 | Kiser | 428/141 |
| 5,580,638 | 12/1996 | Kiser | 428/143 |
| 5,582,864 | 12/1996 | Kiser | 427/186 |
| 5,582,898 | 12/1996 | Kiser | 428/143 |
| 5,587,234 | 12/1996 | Kiser | 428/327 |

FOREIGN PATENT DOCUMENTS 342873 6/1972 U.S.S.R. .

OTHER PUBLICATIONS

Baumen, Compalloy '93, Proc. Int. Congr. Compat. React. Polym. Alloying, 8th (1993), 343–54.

Products Made with Surface–Modified Particles (Apr. 28, 1993).

Izv. Vuzov, Stroit Arkhit, 1986 (5), 52–4, Ovsyannikova, N. N. Bitumen–Polymer Coverings for Athletic Surfaces.

*Primary Examiner*—Hoa T. Le

*Attorney, Agent, or Firm*—John L. Sigalos

[57] ABSTRACT

There are disclosed novel roofing composites comprising a glass-filter fiber roofing mat and a coating containing elastomeric polysulfide and crumb rubber particles distributed substantially uniformly therethrough. The invention also comprises the methods of forming such roofing composites.

12 Claims, 1 Drawing Sheet

ROOFING COMPOSITES AND METHOD

The instant application is a continuation-in-part of application Ser. No. 08/437,592, filed May 9, 1995, now U.S. Pat. No. 5,587,234; which is a division of application Ser. No. 08/187,082, filed Jan. 26, 1994, now U.S. Pat. No. 5,453,313; and a continuation-in-part of application Ser. No. 08/664,770, filed Jun. 17, 1996, now U.S. Pat. No. 5,728,338 which is a division of application Ser. No. 08/561,542, filed Nov. 22, 1995, now U.S. Pat. No. 5,582,898, which is a continuation-in-part of application Ser. No. 08/505,703, filed Jul. 21, 1995, now U.S. Pat. No. 5,580,638, which is a continuation of application Ser. No. 08/187,082, filed Jan. 26, 1994, now U.S. Pat. No. 5,453,313, and a continuation of application Ser. No. 08/474,944, filed Jun. 7, 1995, now U.S. Pat. No. 5,525,399; which is a continuation-in-part of application Ser. No. 08/187,082, filed Jan. 26, 1994, now U.S. Pat. No. 5,453,313.

BACKGROUND OF THE INVENTION

The present invention relates to low cost, wind and impact tolerant roofing composites comprising at least one roofing mat and a coating on at least one surface of said mat having crumb rubber particles distributed substantially uniformly therethrough, and to the method of making such roofing.

The parent applications, whose entire specifications, drawings, and claims are specifically incorporated herein by reference, disclose novel roofing compositions resistant to cracking and hail damage, utilizing elastomeric polysulfides. Due to the cost of the polysulfides, such roofing is costlier than existing roofing compositions and shingles and can mitigate against their use.

Such prior applications also point out that at the present time there are a large number of materials for roofing, such as asbestos, wood, or asphalt shingles, roofing tiles made of cement or clay, slate, coatings of tar, plastic or asphalt, including asphalts modified with elastomeric resins, or some roofing membrane onto which asphalt, tar, or synthetic resin is placed and, in fact, shingles made of Fiberglas.

However, all of these suffer from being insufficiently resilient so as to avoid damages struck by sleet or hail and not being sufficiently resistant to cracking when exposed to the usual thermal cycles of high summer temperatures and low winter temperatures.

These problems are particularly aggravated in the case of shed or flat roofs.

Efforts to use inexpensive materials such as Fiberglas roofing mats, which are conventionally available, have not been successful, even though it is inexpensive, again because of their particular susceptibility to hail damage and lack of resiliency.

SUMMARY OF THE INVENTION

The present invention overcomes the problems of prior art and provides durable roofing composites.

Briefly, the present invention comprises a roofing composite comprising at least one roofing mat and a coating on at least one surface of said mat, said coating comprising a material capable of bonding to said mat, and having crumb rubber particles distributed substantially uniformly therethrough.

The invention further relates to the method of forming such roofing as hereinafter set forth.

DETAILED DESCRIPTION

Figure 1:
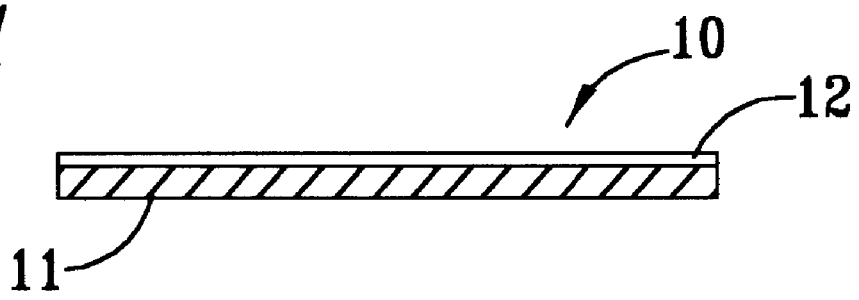
FIG. 1 is a sectional view of a roofing composite in accord with the present invention.

The two essential elements of the composite of the present invention are a roofing mat and a surface coating.

The roofing mats are preferably made of conventional glass fiber (Fiberglas) roofing mats, although for certain of the alternate embodiment of the instant invention other mats made of organic felt, cotton, polypropylene, and the like existing roofing mats can also be used therewith. While the weight of the Fiberglas mat can vary for hail resistance, it is deemed that the weight of the Fiberglas mat should be at least about 0.5 to 2 lbs/square foot.

With respect to the coating, it comprises a material capable of adhering to the Fiberglas mat and containing rubber particles, more particularly those known as crumb rubber, distributed substantially uniformly therethrough. The crumb rubber is made from scrap rubber materials such as old tires and the like, as well as being made from synthetic polymers, such as styrene-butydiene rubber (SBR). These are of various mesh sizes, preferably 20 to 40 mesh U.S. Standard, and obviously various colors. The coating itself must be one that can adhere to the Fiberglas mat. It also must adhere to the other mats used to form the alternate composites. Suitable are polysulfide having the rubber particles dispersed substantially uniformly therethrough or in lieu thereof the modified asphalt as disclosed in one of the parent cases set forth above.

Such modified asphalt is a bituminous-based material, namely a conventional roofing asphalt of Types I through IV. These indicate roofing asphalts having varying softening points and are typed according to the standards set forth in ASTM-D 312-84. It is preferred to modify such asphalts by the addition thereto of a hot melt polysulfide rubber. Such polysulfide are gel types and are available from Morton International under the designation "CR2507". These are of various viscosities, a preferable viscosity being a Brookfield viscosity about 3 poise, but higher viscosities can be utilized. Such polysulfide materials are elastomeric and contain conventional curing agents. Ordinarily the chemical reaction is such that a liquid polysulfide rubber will cure within 24 hours at normal ambient conditions; namely, over about 40° F. Consequently, it is recommended that when roofing in accord with this invention is to be applied that it not be applied at a temperature lower than 40° F.

As is conventional, materials can be added to the coating to minimize ultraviolet degradation and to provide fire-resistant and self-extinguishing properties and, if desired, to increase the strength. Such materials include the usual conventional ultraviolet absorbers and fillers, such as silicates, carbonates, and carbon black. Use of crumb rubber which contains amounts of such fillers and UV absorbers can eliminate the need to use additional amounts of such additives.

The modified asphalt coating is placed on the Fiberglas mat by spreading it thereover by any conventional means in an amount sufficient to saturate the mat and leave an amount on the surface sufficient to adhere the roofing granules to the composite. When multi-mat composites are formed, the coating is placed between the mats and on the upper surface to a thickness sufficient to saturate the mats and to leave a thickness on the surface sufficient to adhere roofing granules and a thickness between the mats to have a discreet coating layer. The amount of coating will vary dependent upon the particular thickness of the mat(s) used and the degree of hail and wind resistance desired. Such thickness for any given combination of mat(s) and coating can be determined by routine experimentation.

For fire retardancy, it is preferred to use roofing aggregate by-product dust. Such by-product dust is left over when aggregate is ground to make conventional roofing aggregate that is placed on roofing and on shingles. It has been found, surprisingly, that such roofing aggregate by-product dust gives excellent fire retardancy and greatly reduces the flaming of the roofing materials.

The modified asphalt discussed above containing the polysulfide and crumb rubber particles is applied as an outer coating onto the outer layer of the Fiberglas roofing mat. It will saturate the mat and also leave a surface layer. This strengthens the composite to make it wind and hail resistant.

If desired, and as is conventional, roofing aggregate (gravel) is placed over the coating to give the desired color and texture for ornamental purposes and also to strengthen the roofing.

With respect to proportions, when a modified asphalt adhesive is used, the asphalt is the major component and for each 100% by weight thereof there is added about 5 to 70% by weight elastomeric polysulfide and 10 to 35% by weight crumb rubber. It is preferred to use the lowest amount of polysulfide required to give hail resistance in order to minimize the amount of costly polysulfide used. As a rule the colder the geographical area in which the roofing is to be used the greater the amount of polysulfide needed to ensure the desired properties. In the colder climates, more of the polysulfide is required in order to have the proper flexibility of the composition due to the brittleness of asphalt at low temperatures.

The roofing aggregate by-product dust which is used as a fire retardant can also function as a filler and strengthener of the coating layer and can be used at ranges of 10 to 50% by weight for each 100% by weight of asphalt, preferably about 25 to 30. Such amount of retardant does lower the elasticity of the adhesive layer, but it is important in that it gives the desired fire retardancy necessary for asphaltic roofing.

The method of preparing the composition for flat roofing is to first adhere the Fiberglas mat to the deck. The asphalt which is usually sold in block form in order to bring it to the molten state, usually depending upon the type of roofing asphalt used, a temperature of about 380 to 520° F. To this composition in a conventional roofing kettle is added the polysulfide and crumb rubber, together with the other components of the mix, such as the additives noted above, and particularly the fire retardant materials, and the mass thoroughly admixed. This molten composition can then be applied by any of the means conventionally utilized in applying roofing asphalt; namely, by being trowelled, pumped, brushed sprayed, or mopped onto any number of the roofing mats. At the higher temperatures and with the finer size crumb rubber particles, such particles will also become molten and lose their particle form. However, the resultant rubber becomes dispersed throughout the composition and still exerts its beneficial effect.

It is a feature of the instant invention that the coating can be made as described above in a manufacturing facility and packaged in block form as is the case with unmodified roofing asphalt. It can then be taken to the job site and melted for application without any need to add and admix any components.

In forming new roofing and in using the composition over old roofing, the Fiberglas mat is placed on the surface of the already formed roof, such mat being preferably made of conventional Fiberglas roofing mats, such as types used for Class A, B, or C, or even non-rated roofing shingles. Also, the conventional roofing felt used for built-up-roofing is suitable, as is organic felt. All of these are conventionally used in making roofing. Some of these, however, in contrast to Fiberglas, have low fire retardancy and are not recommended.

After the mat is placed on the roof, the coating layer is applied. It will be evident that more than two layers of mats can be used with, of course, the coating layer applied between the mats and on the outer surface of the uppermost Fiberglas mat.

For other than flat roofing, self-supporting roofing shapes such as shingles, shakes, tiles, panels, and other overlapping roofing unit types can be made. Their manufacture is accomplished in the usual manner by first forming a composite of the mat and the coating layer as discussed above and then forming the same into the shape desired by the usual techniques. This includes the cutting of the composite when cured into the shape desired and, as is conventional, having the outer surface of the shingles, for example, covered with a roofing aggregate. It is also possible to color the shapes with a decorative color, as is conventional, using the materials conventional for this purpose for asphalt shingles. The composition can be used alone to form the shape, or applied to any suitable roofing base material. The thickness of the shingles can vary widely, as is common for shingles and other roofing shapes.

Referring to the drawings, FIG. 1 shows a section of a shingle 10 comprising the composite described above in its cured and shaped form with mat 11 and coating 12. Not shown are roofing granules which can be added to the coating layer for additional hail resistance and decorative effect.

Figure 2:
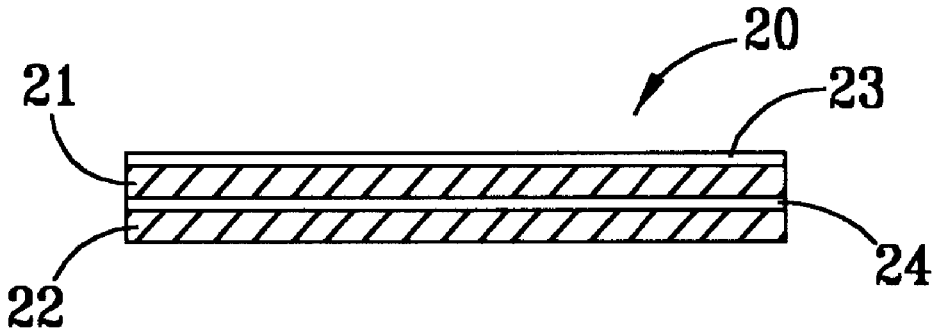
FIG. 2 is a sectional view of roofing in accord with an alternate embodiment of the invention.

FIG. 2 is a sectional view of an alternate embodiment of the invention in which more than two mat layers are utilized. It comprises mat layers 21 and 22, coating layers 23 and 24. This results in a stronger shingle that is more resistant to sleet and hail damage. It will be evident that more than two mat layers can be utilized.

In these alternate embodiments it is preferred to use Fiberglas roofing mats for all of the mat layers, although it is possible to use a Fiberglas mat for the uppermost layer and to use one of the other mats described above for the inner mat(s).

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A roofing composite comprising a glass fiber roofing mat and a coating on said mat, said coating comprising an elastomeric polysulfide having crumb rubber particles distributed substantially uniformly therethrough.

2. The roofing composite of claim 1 wherein said coating comprises an elastomeric polysulfide, a modified asphalt suitable for roofing containing an elastomeric polysulfide, or a mixture thereof, and said crumb rubber particles are formed from scrap rubber, styrene-butydiene rubber, or mixtures thereof.

3. The roofing composite of claim 1 or 2 in the form of a self-supporting roofing shape.

4. The roofing composite of claims 1 or 2 in the shape of a shingle.

5. The roofing composite of claim 1 or 2 wherein said coating contains a fire retardant.

6. The roofing composite of claim 1 or 2 wherein said coating contains an ultra-violet absorber.

7. The method of making a roofing composite comprising forming a coating comprising an elastomeric polysulfide having crumb rubber particles distributed substantially uniformly therethrough and placing said coating onto at least one surface of a glass fiber roofing, said coating being capable of adhering to said mat.

8. The method of claim 7 wherein at least two mats are utilized, one of which is a glass fiber roofing mat, and said at least two mats are coextensive in shape.

9. The method of claim 8 wherein said composite is then made in the shape of a shingle.

10. The method of claim 7, including applying roofing granules over the coating.

11. The method of claim 7 or 10 wherein said coating layer contains a fire retardant.

12. The method of claim 7 or 10 wherein said coating layer contains an ultra-violet absorber.

* * * * *